United States Patent [19]

Johnson et al.

[11] 4,350,919

[45] Sep. 21, 1982

[54] MAGNETICALLY FOCUSED STREAK TUBE

[75] Inventors: Charles B. Johnson; Jimmy M. Abraham, both of Fort Wayne, Ind.

[73] Assignee: International Telephone and Telegraph Corporation, New York, N.Y.

[21] Appl. No.: 948,849

[22] Filed: Oct. 5, 1978

Related U.S. Application Data

[63] Continuation of Ser. No. 834,591, Sep. 19, 1977, abandoned, which is a continuation of Ser. No. 708,813, Jul. 26, 1976, abandoned.

[51] Int. Cl.[3] ..... H01J 40/04; H01J 31/50

[52] U.S. Cl. ..... 313/99; 250/213 VT

[58] Field of Search ..... 313/94, 99, 101, 102, 313/381, 95; 250/213 VT

[56] References Cited

U.S. PATENT DOCUMENTS

| | | | |
|---|---|---|---|
| 2,603,418 | 7/1952 | Ferguson | 313/381 X |
| 3,310,678 | 3/1967 | Kylander et al. | 313/95 X |
| 3,391,295 | 7/1968 | Clayton | 313/94 X |
| 3,432,711 | 3/1969 | Clayton | 313/381 |
| 3,714,439 | 1/1973 | Williams et al. | 250/213 VT X |
| 3,761,614 | 9/1973 | Bradley | 313/94 X |
| 3,973,117 | 8/1976 | Bradley | 313/381 X |
| 4,012,657 | 3/1977 | Loty | 250/213 VT X |
| 4,021,693 | 5/1977 | Bradley et al. | 250/213 VT X |

FOREIGN PATENT DOCUMENTS

| | | | |
|---|---|---|---|
| 906923 | 2/1946 | France | 313/101 |
| 1074044 | 6/1967 | United Kingdom | 250/213 VT |

*Primary Examiner*—Robert Segal

*Attorney, Agent, or Firm*—John T. O'Halloran; Alfred C. Hill

[57] ABSTRACT

A vacuum envelope having a longitudinal axis and a light input faceplate disposed coaxial of the axis and at one end of the tube includes therein coaxially of the axis adjacent the faceplate a photocathode which is responsive to an optical pulse train to emit electrons in the envelope in a direct proportion to incident photon flux of the optical pulse train. Electric field deflection plates are disposed within the envelope and spaced along the longitudinal axis from the photocathode toward the other end of the tube to produce an electric field perpendicular to the longitudinal axis to deflect the electrons. A readout device is disposed within the envelope and coaxial of the axis at the other end of the tube to provide a readout for the tube. A magnetic focusing device is disposed externally of the envelope and coaxial with the longitudinal axis to provide a magnetic field within the envelope perpendicular to the electric field to focus the electrons on the readout device. Several embodiments are disclosed.

33 Claims, 12 Drawing Figures

OPERATING PARAMETERS:

V (K) = -2.0 KV
V (G1) = V(G2) = 0
V (T) = 8.3 KV
$L_3$ = 10mm (PARALLEL) PLUS 10mm (@ 15° TO AXIS)

X = 2.0mm (MIN)
X = 7.2mm (MAX)
FOCUS COIL FIELD/CURRENT RATIO 9.0mT/A (90G/A)

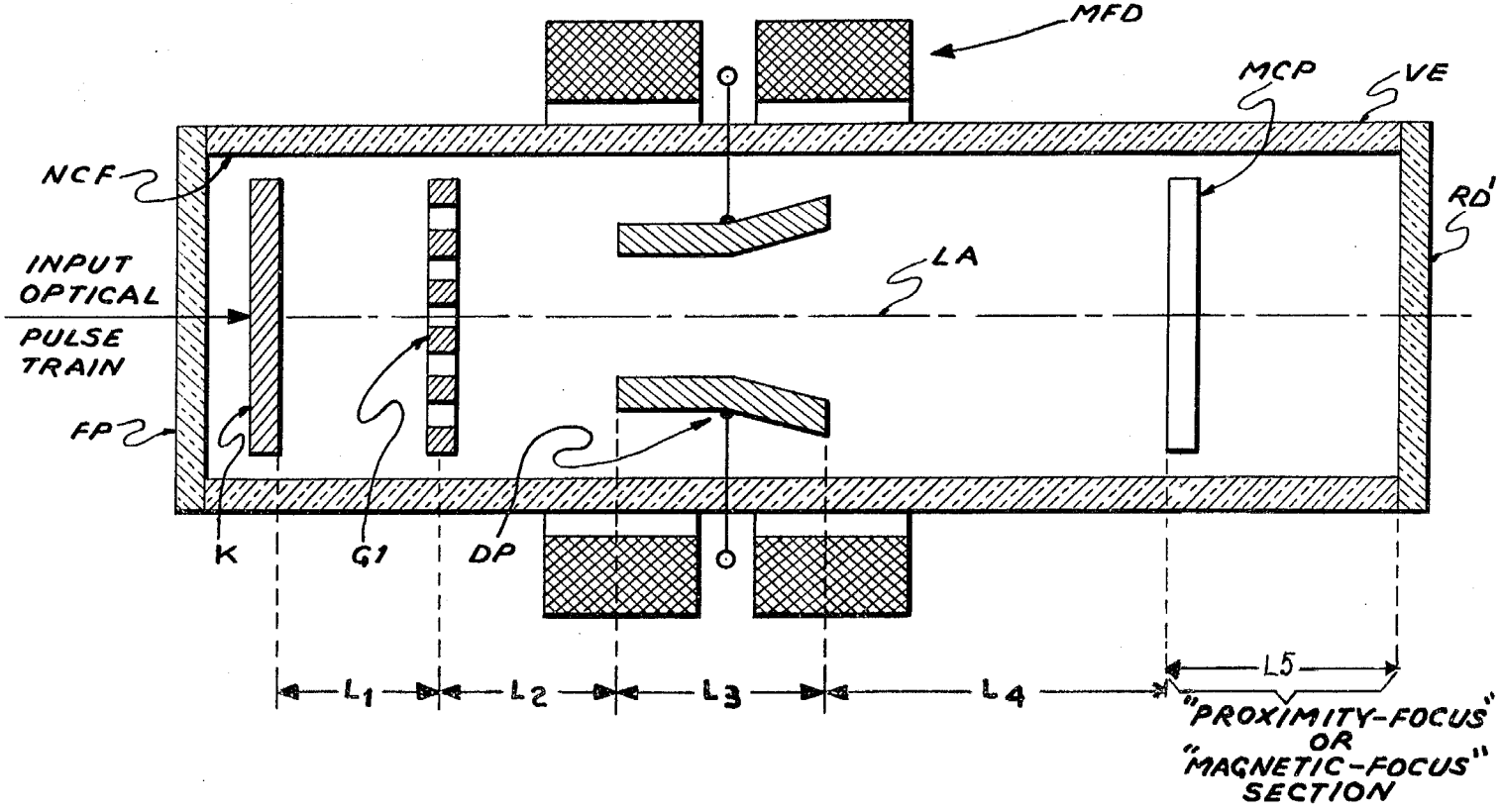
Fig. 10
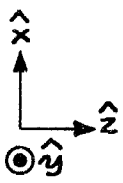

MAGNETICALLY FOCUSED STREAK TUBE

CROSS-REFERENCE TO RELATED APPLICATIONS

This is a continuation application of application Ser. No. 834,591, filed Sept. 19, 1977 (now abandoned), which is a continuation application of application Ser. No. 708,813, filed July 26, 1976 (now abandoned).

BACKGROUND OF THE INVENTION

This invention relates to photoelectron tube sensors and more particularly to a streak tube.

A photoelectronic tube can be used to detect optical events which occur in very short time intervals. The generic name "streak tube" is commonly given to such high-speed optical event photoelectron tube sensors. Prior art streak tubes normally employ electrostatic electron lenses for the purpose of focusing electrons on the readout device of streak tubes. The electrostatic focused streak tubes have disadvantages of limiting temporal and spatial resolution.

SUMMARY OF THE INVENTION

An object of the present invention is to provide a streak tube having improved limiting temporal and spatial resolution performance as compared to the conventional electrostatically focused streak tubes.

Another object of the present invention is to provide a magnetically focused streak tube employing electric field electron deflection.

It has been determined that electromagnetic focusing device for streak tubes generally produce better electron optical image transfer properties than electrostatic electron focusing lenses. Furthermore, high limiting temporal event resolution is found to improve as the electron optical image transfer quality improves, if all other tube parameters remain constant. Suitable electric field deflection plate structures and designs as will be described hereinbelow for use in a magnetically focused streak tube provide practical deflection sensitivities in the plane or surface of electron focus as indicated by solving the electron equations of motion under operational conditions.

A feature of the present invention is the provision of a magnetically focused streak tube comprising: a vacuum envelope having a longitudinal axis and a light input faceplate disposed coaxial of the axis at one end of the tube; first means disposed coaxial of the axis and within the envelope adjacent the faceplate responsive to an optical pulse train to emit electrons into the envelope in a direct proportion to incident photon flux of the pulse train; second means disposed within the envelope and spaced along the axis from the first means toward the other end of the tube to produce an electric field perpendicular to the axis to deflect the electrons; third means disposed within the envelope, coaxial of the axis and spaced along the axis from the second means at the other end of the tube to provide a readout for the tube; and fourth means disposed externally of the envelope and coaxial with the axis to provide a magnetic field within the envelope perpendicular to the electric field to focus the electrons on the third means.

BRIEF DESCRIPTION OF THE DRAWING

Above-mentioned and other features and objects of this invention will become more apparent by reference to the following description taken in conjunction with the accompanying drawing, in which:

FIG. 10 is a schematic longitudinal cross-sectional view of a fourth embodiment of a magnetically focused streak tube in accordance with the principles of the present invention;

DESCRIPTION OF THE PREFERRED EMBODIMENTS

Figure 1:
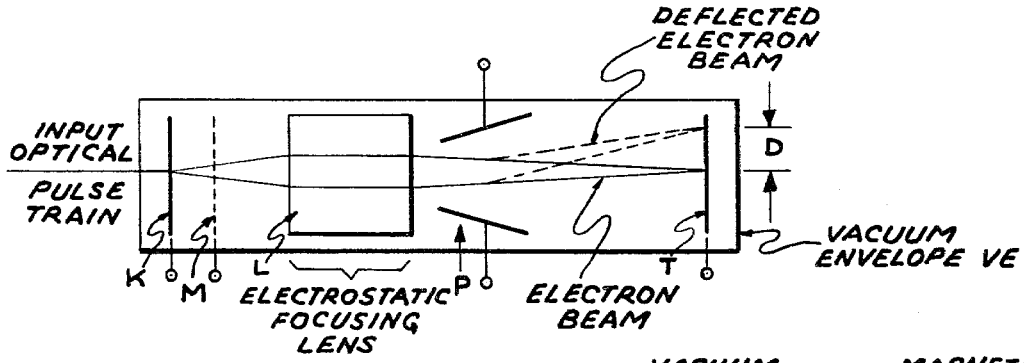
Fig. 1 (PRIOR ART)
FIG. 1 is a schematic diagram of a prior art electrostatically focused streak tube.

Referring to FIG. 1 there is illustrated therein the main functional elements of a conventional streak tube employing electrostatic focusing lenses. The principle of operation of streak tubes is that a light pulse train from a high-speed optical event or generator is focused onto a photocathode K contained within a vacuum envelope VE. The photocathode emits electrons into envelope VE in direct proportion to the incident photon flux of the optical pulse train. The electrons are rapidly accelerated by an electron transparent mesh electrode M, the electrons then being deflected by the action of an electric field deflection plate structure P. The deflected electron beam is focused by the action of an electrostatic electron lens L onto an electron target T. The output electron streak pattern on the target T is interrogated by some appropriate means to determine the time duration and repetition rate of the high-speed input optical events.

No streak tubes having electric field deflection assemblies are known that employ magnetic focusing in place of electrostatic focusing. Magnetic focusing is used in the streak tube of the present invention as will be described hereinbelow to achieve higher limiting temporal and spatial resolutions than possible with electrostatic lenses. Electric field deflection is necessary and commonly employed in streak tubes because of the fundamental difficulty of achieving high frequency magnetic field deflection. For this reason, electric field deflection is used for the magnetic streak tube designs illustrated and described herein. An important difference of the magnetically focused streak tube and the electrostatically focused streak tube is that a focusing magnetic field is maintained perpendicular to the deflection electric field. This causes the electrons to travel in cycloidal paths while inside the deflection region, and the electron deflection characteristics are altogether different than for the case in which the magnetic field is absent. Two limiting modes of operation result from this kind of electric field deflection in the presence of a magnetic focusing field, corresponding to the conditions for maximum and minimum exit deflection field-induced kinetic energy.

It has been shown that maximum and minimum energies transverse to the magnetic focus field are given to the electrons in the deflection region when they spend time periods of $T_c/2$ or $T_c$ within the deflection region, respectively, where the electron cyclotron period $T_c$ is given by $T_c=2\pi/w$, $w=uB$, where u is the electron charge/mass ratio, and B is the magnetic flux density. For electrons which spend a period $T_c/2$ within the deflection region, a 1-loop focus design is realizable. However, fringing electric fields near the entrance and exit of the deflection region can cause "S-distortion" in the output image trace if the electrons pass close to the deflection plates when moving through the entrance or exit of the deflection plate region. If an integral number of electron cyclotron periods are spent in the deflection region, then multiple-loop focus designs are possible, and the effects of the deflection plate fringing fields can be shown to be negligible. Furthermore, the deflection and deflection sensitivity design characteristics of the magnetically focused streak tube having electric field deflection plates is clearly described by mathematical relationships in terms of the tube dimensions, the applied electric potentials, and the applied magnetic focusing field.

First, the focus and deflection characteristics of an experimental magnetically focused streak tube (MST) will be analyzed, in which the electrons spend less than one cyclotron period inside the deflection region. Then, the design characteristics of the MSTs for which electrons spend an integral number of cyclotron periods inside the deflection region will be described.

The motion of an electron which travels from the photocathode K to the output screen, target or readout device RD of the MST can be determined by finding its motion through each of the five major tube regions, consecutively. These sections are listed in TABLE I along with the components of the electric and magnetic fields which exist in each section.

TABLE I

| REGION | LENGTH | FIELD COMPONENTS PRESENT | TRANSIT TIME (ns) |
|---|---|---|---|
| $L_1$ (Photocathode→G1) | $L_1$ = 2 mm | $E_z,B_z$ | 0.151 |
| $L_2$ (G1→Deflection Plates) | $L_2$ = 42 mm | $B_z$ | 1.58 |
| $L_3$ (Deflection Region) | $L_3$ = parallel plate region 10 mm + 10 mm in 30° plate region | $E_x,B_z$ | 0.754 |
| $L_4$ (Deflection Region→G2) | $L_4$ = 83 mm | $B_z$ | 3.13 |
| $L_5$ (G2→Screen) | $L_5$ = 9 mm | $E_z,B_z$ | 0.210 |
| | | | 5.83 |

The Lorentz force equation $$\vec{F}=q(\vec{E}+\vec{v}\times\vec{B}) \quad (1)$$

is solved to find the electronic motion in each section, where $\vec{F}$ is the force, q is the particle charge, $\vec{E}$ is the electric field, $\vec{v}$ is the electron velocity, and $\vec{B}$ is the magnetic field. Cartesian coordinates are chosen, so that $\vec{F}/m=x''\hat{x}+y''\hat{y}+z''\hat{z}$, $\vec{E}=E_x\hat{x}+E_y\hat{y}+E_z\hat{z}$, $\vec{v}=x'\hat{x}+y'\hat{y}+z'\hat{z}$, and $\vec{B}=B_x\hat{x}+B_y\hat{y}+B_z\hat{z}$, where $X''=d^2=/dt^2$, $x'=d\times/dt$, etc. It is assumed that the longitudinal axis of the MST coincides with the $\hat{z}$ axis, and that the $+\hat{z}$ direction is away from the photocathode K and toward the readout device RD. The length of each region of the experimental MST is listed in TABLE I. The total distance between the photocathode K and the readout device RD as shown in FIG. 2 is 156 mm (millimeters).

Figure 2:
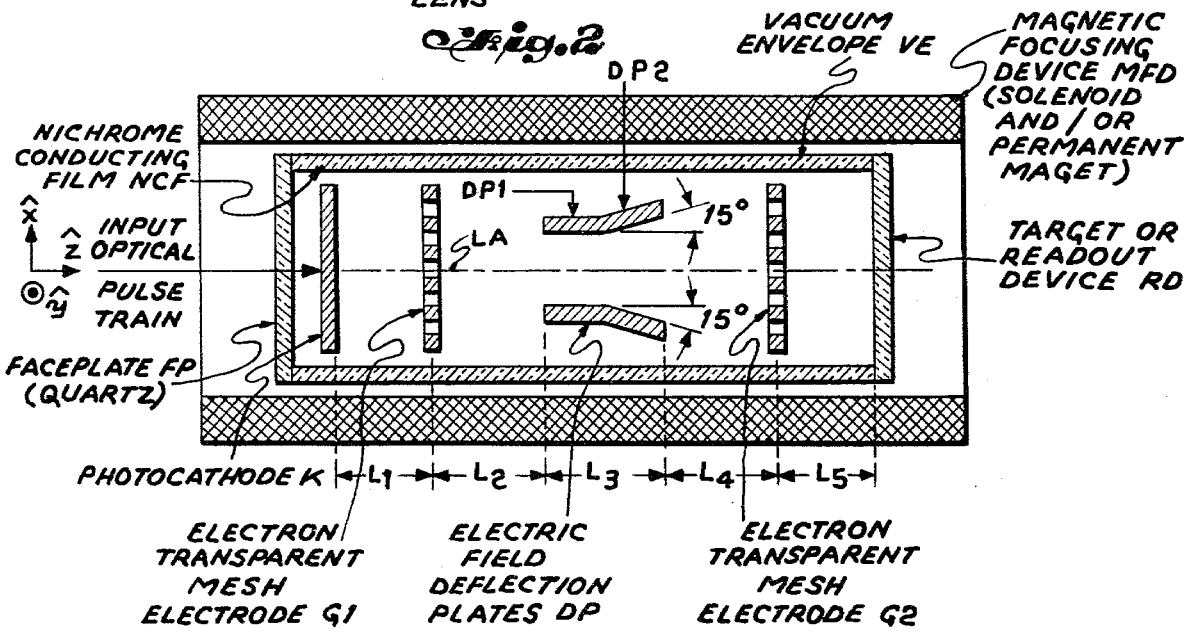
FIG. 2 is a schematic longitudinal cross-sectional diagram of one embodiment of the magnetically focused streak tube in accordance with the principles of the present invention.

FIG. 2 illustrates one embodiment of the MST in accordance with the principles of the present invention which includes a vacuum tight envelope VE having faceplate FP through which the input optical pulse train passes to a photocathode K which is coaxial of the longitudinal axis LA of envelope VE. After the electron traverses region $L_1$ it encounters an electron transparent mesh electrode $G_1$ and enters region $L_2$ prior to entering the electric field deflection plates DP. It should be noted that the deflection plates may be divided into two portions, a first portion DP1 where the deflection plates are parallel to one another and a second portion DP2 where the deflection plates are disposed at a 15° angle with respect to the deflection plates in the portion DP1. Plane-parallel deflection plates may also be used. After being deflected, the electron traverses region $L_4$ before it encounters a second electron transparent mesh electrode G2. After leaving G2, the electron passes through region $L_5$ and streaks the readout device RD which may be and is illustrated as a phosphor screen. However, readout device RD may be a microchannel plate, television-type camera tube gain/storage target (secondary electron-conduction arrays, glass, magnesium oxide (MgO), silicon diode arrays and so forth) and electron or photon input self-scanned arrays (charge-coupled devices, charge-injection devices, Reticon arrays and so forth). When the microchannel plate is utilized as the readout device, another electron target or readout device of any of the above types mentioned, or combinations thereof, would need to be used employing "proximity" or "electromagnetic" focusing between the output face of the microchannel plate and the added readout device. The internal wall of envelope VE is coated with a Nichrome conducting film NCF to hold the inside wall of envelope VE at a constant potential. The focusing of the electron or electrons in envelope VE is provided by a magnetic focusing device MFD which may be a solenoid and/or permanent magnet. In the embodiment illustrated in FIG. 2, the magnetic focusing device MFD has the streak tube completely immersed therein by having a length which is longer than the length of the tube itself as illustrated.

Let us first consider the electron transit times in each region for an electron which leaves photocathode K at rest. The time of flight or transit time in region $L_1$ is given by $$T_1=L_1[-2/(uV_g)]^{\frac{1}{2}}, \quad (2)$$

and the transit times through regions $L_2$, $L_3$ and $L_4$ are given by $$T_2=L_2/(-2\,uV_g)^{\frac{1}{2}}, \quad (3a)$$

$$T_3=L_3/(-2\,uV_g)^{\frac{1}{2}}, \text{ and} \quad (3b)$$

$$T_4=L_4/(-2\,uV_g)^{\frac{1}{2}}, \quad (3c)$$

where u is the electron charge/mass ratio ($-e/m=-1.76\times10^{11}$), in MKS-units, and $V_g$=first-mesh electrode (G1) applied potential defined by $E_{xl}=-V_g/L_1$, if it is assumed that the cathode is grounded, i.e. V(K)=0. Only the case in which electrodes G1 and G2 are held at the same potential is considered here, i.e. $V(G1)=V(G2)=V_g$, so that the deflection plate region $L_3$ is located between two regions $L_2$ and $L_4$ in which the electric strength is assumed to be zero.

The time of flight in region $L_5$ is found by solving the quadratic equation $$L_5=(-2\,uV_g)^{\frac{1}{2}}T_5+uE_5T_5^2/2 \quad (4)$$

for $T_5$, where $E_5=(V_g-V_s)/L_5$, and Vs is the screen potential. Thus, $$T_5=(-2/u)^{\frac{1}{2}}L_5/(V_s^{\frac{1}{2}}+V_g^{\frac{1}{2}}). \quad (5)$$

The baseline operating and design parameters of a first experimental MST are listed in TABLE II. These values were used to find the transit times from equations (2), (3) and (5) and listed in TABLE I.

TABLE II

| | |
|---|---|
| V(K) | 0 kV |
| V(G1) = V(G2) = Vg | 2.00 kV |
| V(S) | 10.0 kV |
| Deflection Region Center Potential | 2.00 kV |
| Maximum Output Sweep Length | 40 mm |
| Input Faceplate Material | UV—(ultraviolet) Grade Quartz |
| Input Faceplate Thickness | 3.18 mm (0.125") |
| Mesh Parameters (G1 and G2) | 19.7 lines/mm Nickel, 60% Transmission |
| Magnetic Flux Density (1st-loop focus) | 6.13 mT (millitesla) (61.3G (gauss)) |

For N integral loops of focus (N=1, 2, 3 . . . ) the total electron transit time $$\left(\sum_{i=1}^{5} T_i\right)$$

must equal an integral number of electron cyclotron periods ($NT_c$), so that equations (2), (3a), (3b), (3c) and (5) can be used with $T_c=2\pi/(uB)$ to find the focus equation:

$$B=\frac{(-2/u)^{\frac{1}{2}}\,2\pi\,N\,V_g^{\frac{1}{2}}\,(V_s^{\frac{1}{2}}+V_g^{\frac{1}{2}})}{(2L_1+L_2+L_3+L_4)(V_s^{\frac{1}{2}}+V_g^{\frac{1}{2}})+2L_5\,V_g^{\frac{1}{2}}}, \quad (6)$$

where $2\pi\,(-2/u)^{\frac{1}{2}}=2.12\times10^{-5}$.

The deflection characteristics of the MST operated at 1-loop focus are now described in detail. Electrons spend a small fraction (13%) of a cyclotron period inside the deflection region $L_3$, as shown in TABLE I. For the baseline design and operating parameter given in TABLE II, the magnetic flux density is found from equation (6) to be 6.13 mT (61.3G). Since the electron cyclotron period $T_c$ is given by $$T_c=2\pi/w_c-2\pi/(uB), \quad (7)$$

where $w_c=-1.76\times10^{11}\times6.13\times10^{-3}=-1.08\times10^{9}$ rad/s (radians per second) is the cyclotron frequency, it is found that $T_c$=5.82 ns (nanoseconds).

The electron transit time $T_3$ in the deflection region $L_3$ is $$T_3=1.69\times10^{-6}\,L_3/V_g^{\frac{1}{2}}, \quad (8)$$

where $L_3$ is the length of the deflection region and $V_g$ is the first-mesh (G1) applied potential. It is seen from TABLES I and II that $L_3$=20.0 mm (millimeters) and $V_g$=2.00 kV (kilovolts) so that the transit time $T_3$ in region $L_3$ equals 754 ps (picoseconds). Note that the deflection electric field accelerates electrons primarily in a direction perpendicular to the deflection plates DP and the magnetic field. For small applied deflection potentials, the electrons leave the deflection region $L_3$ with a component of velocity perpendicular to the magnetic field given by $$V_\perp=u\,E_dT_3, \quad (9)$$

where the electric field strength in the deflection region $E_d$ is given by the ratio of the potential difference between the deflection plates ($V_d$) and the deflection plate spacing (X). This perpendicular component of velocity causes the "deflected" electrons to travel in a circular helix of radius $R_c$, where $$R_c=v_\perp/w_c. \quad (10)$$

Note that, for the assumptions imposed, the electrons experience negligible acceleration in the $\hat{z}$ direction while inside the deflection region $L_3$, so that the electrons leave with an axial velocity component $v_z=(-2\,uV_g)^{\frac{1}{2}}$. Also, the total transmit times through regions $L_4$ and $L_5$ are equal for "deflected" and "undeflected" electrons. The electron trajectory in region $L_4$ is a helix of constant pitch and radius $R_c=4.92\times10^{-5}\,V_d$. In region $L_5$ the electrons are accelerated in the z direction only, so that they travel in a helix of increasing pitch while the radius of its helical trajectory is unchanged from that of region $L_4$.

Figure 3:
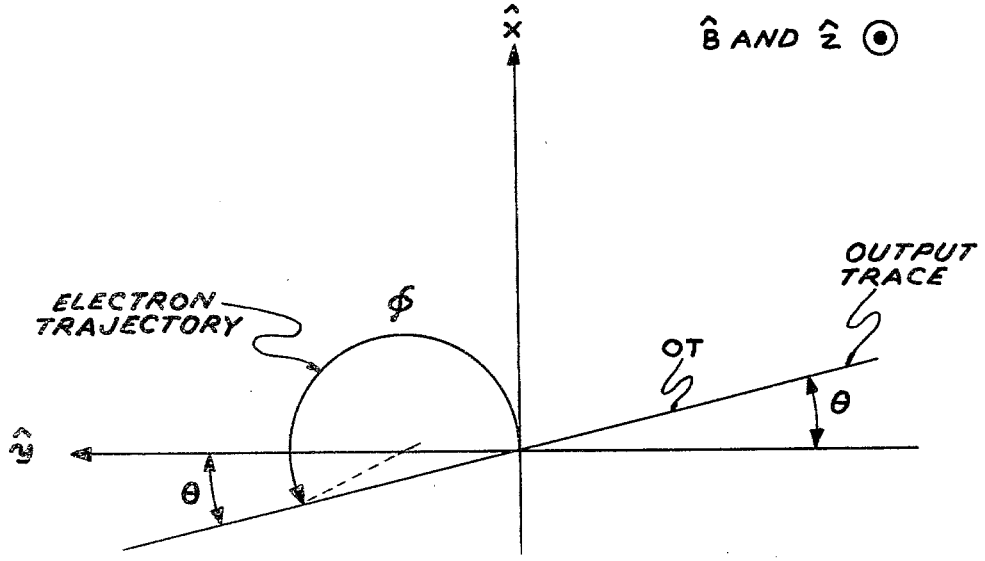
FIG. 3 is a diagram illustrating the rotation of the output trace of the magnetically focused streak tube in accordance with the principles of the present invention.

Thus, for this small deflection analysis, all electrons which leave the deflection region $L_3$, whether "deflected" or not, appear to travel in a circular are when viewed in the $-\hat{z}$ direction (from the readout device RD toward the photocathode K) as illustrated in FIG. 3. The angles of these circular arcs $\phi$ are equal because the transit time in regions $L_4$ and $L_5$ are equal and $w_c$ is constant for a fixed B, where $$\phi=2\pi(T_4+T_5)/T_c \tag{11}$$

Figure 4:
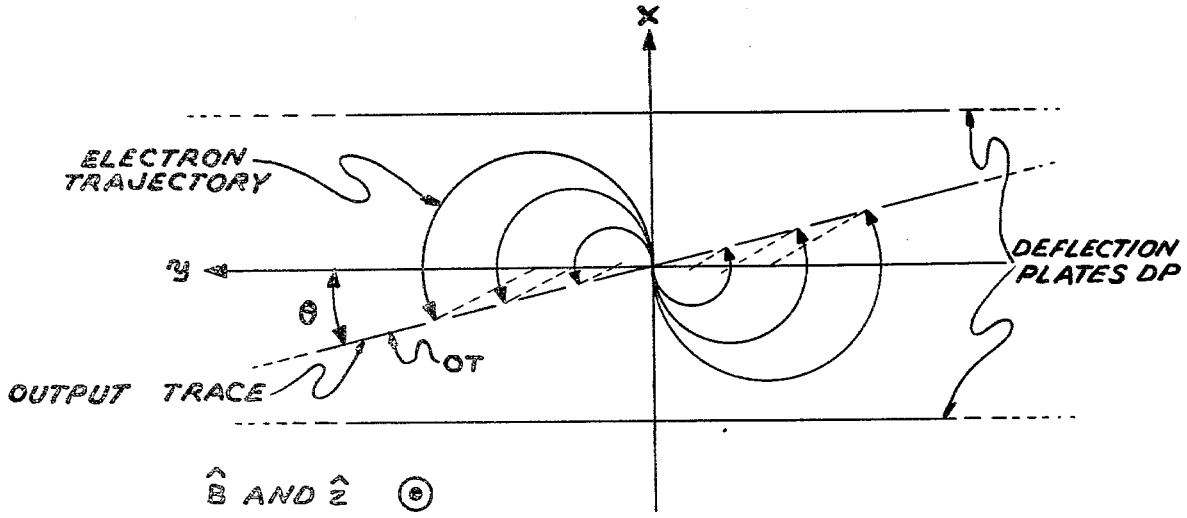
FIG. 4 is an illustration of deflected rest electron trajectories and output trace present in the magnetically focused streak tube in accordance with the principles of the present invention.
Figure 5:
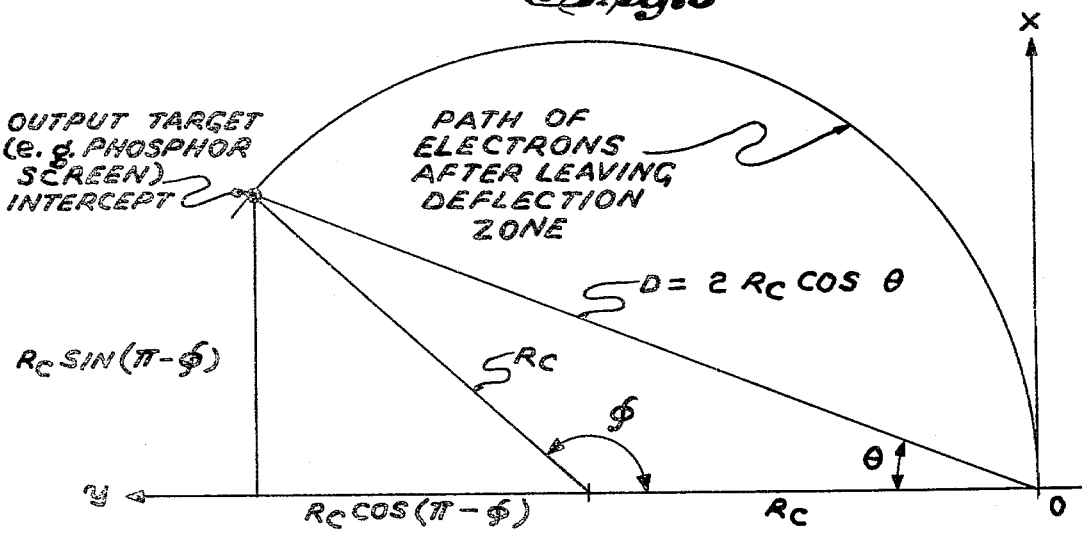
FIG. 5 is an illustration showing the relation between the cyclotron angle $\Phi$ and deflection angle $\theta$.

This transit time angle $\phi$ and the corresponding angle $\theta$ that the output trace OT makes with the planes of the plane-parallel deflection plates DP are shown schematically in FIGS. 4 and 5, where $$\theta=\cos^{-1}[(1-\cos\phi)^{\frac{1}{2}}/2^{\frac{1}{2}}]. \tag{12}$$

Thus, a linear output trace OT is produced which makes an angle $\theta$ with the planes of the deflection plates DP as shown in FIG. 4.

The general expression for beam deflection D is seen from FIG. 5 to be $$D=2R_c\cos\theta \tag{13}$$

Note:

$$\theta=\tan^{-1}[\sin(\pi-\phi)]/[\cos(\pi-\phi)+1],$$

$$\theta=\tan^{-1}[\sin\phi)/(1-\cos\phi)], \text{ or}$$

$$\theta=\cos^{-1}[(1-\cos\phi)^{\frac{1}{2}}/2^{\frac{1}{2}}]$$

Equation (13) can be rewritten in terms of the tube parameters by using equations (9)—(12), so that $$D=V_d[L_3/(X\,B)](1-\cos\phi)^{\frac{1}{2}}/(-2\,uV_g)^{\frac{1}{2}}. \tag{14}$$

From equation (14) it is seen that the deflection sensitivity H is $$H=[L_3/(X\,B)](1-\cos\phi)^{\frac{1}{2}}/(-2\,uV_g)^{\frac{1}{2}}.$$

The baseline operating parameters given in TABLE II for the experimental tube operated at "1-loop focus" yield a theoretical deflection sensitivity of $H_t=0.089$ mm/V.

It is seen from equation (14) that the beam is undeflected at the readout device RD for $\phi=2\pi, 4\pi, 6\pi, \ldots$, since the electron trnsmit times from the deflection plate region $L_3$ to readout device RD are equal to integral multiples of the electron cyclotron period $T_c$ for these values of $\phi$. For example, if $\phi=2\pi$, then $T_5+T_5=T_c$ so that $$L_4/(-2\,uV_g)^{\frac{1}{2}}+(-2/u^{\frac{1}{2}}L_5/(V_s^{\frac{1}{2}}+V_g^{\frac{1}{2}})=2\pi/(-uB_1),$$

or $B_1=10.7$ mT (107G), which is found by using the values given in TABLE II. This theoretical value for $B_1$ agrees reasonably well with the experimentally determined value of $B_{exp}=9.5$ mT for the assuptions used in this analysis and the experimental errors.

Note also from equation (14) and FIG. 5 that the maximum deflection occurs when $\phi=\pi, 3\pi, 5\pi, \ldots$, or $T_4+T_5=T_c/2, 3T_c/2, 5T_c/2, \ldots$, for a given set of operating values ($V_d$, $L_3$, X, B and $V_g$). Note also that two orthogonal sets of deflection plate assemblies may be used to produce circular, spiral, or other scan shapes.

Figure 7:
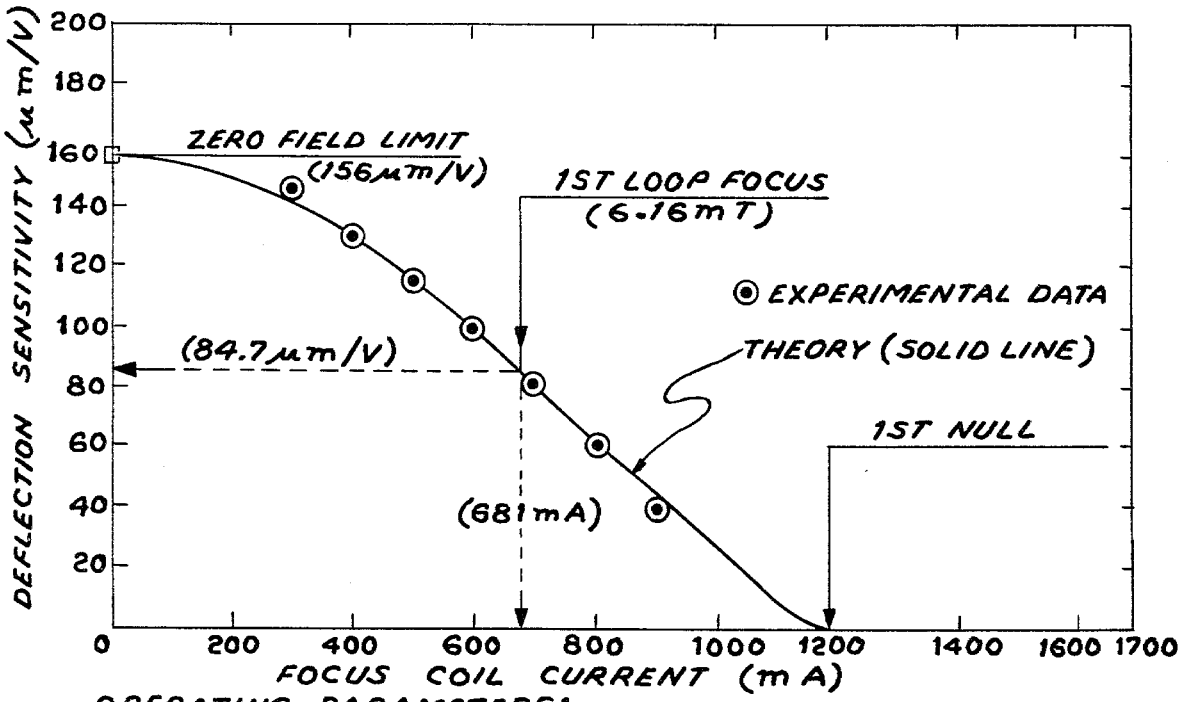
FIG. 7 is a graph illustrating the comparison between theoretical and experimental deflection and sensitivity performance of the magnetically focused streak tube in accordance with the principles of the present invention.

FIG. 7 illustrates measured data of deflection sensitivity versus focus coil current where the magnetic focusing device MFD is a solenoid obtained from the first experimental tube. The baseline operating parameters of this tube, given in TABLE II, where used in equation (15) to plot the theoretical deflection sensitivity curve. Excellent agreement between theory and experiment is observed. The low field ($B\sim O$) deflection sensitivity limit is found from equation (15) to be $$H_0=L_3[L_4+2\,V_g^{\frac{1}{2}}L_5/(V_s^{\frac{1}{2}}+V_g^{\frac{1}{2}})]/(2\times V_g), \tag{16}$$

so that $H_0=156$ $\mu$m/V (micrometer per volt) for the experimental tube.

Figure 6:
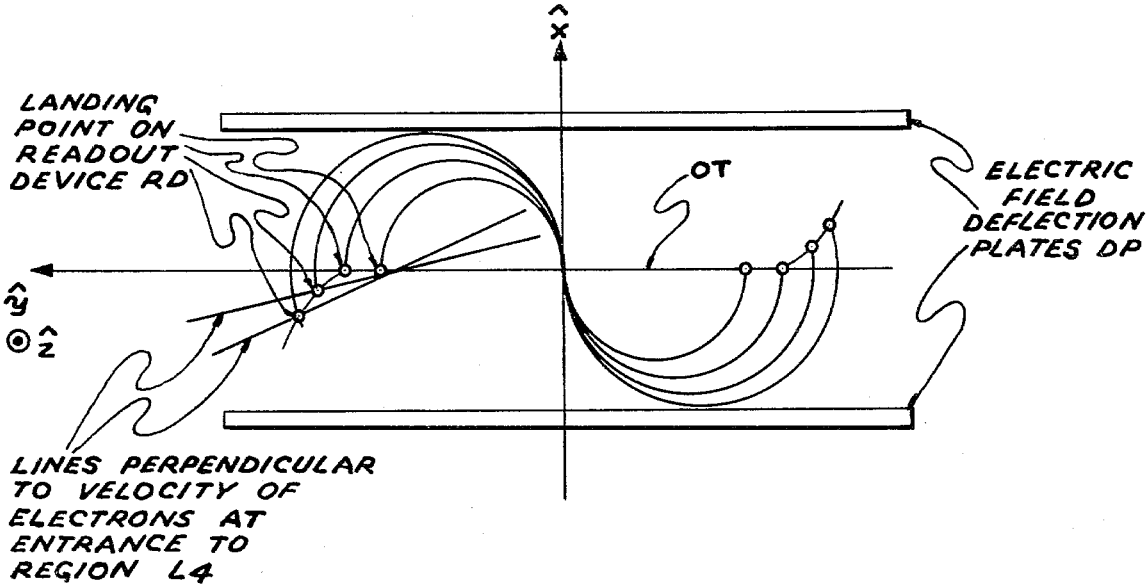
FIG. 6 illustrates the electron motion in regions $L_4$ and $L_5$ illustrating the cause of "S-distortion" in streak tubes.

It is noted that the output trace OT of an MST having the configuration of FIG. 2 is not a perfect straight line, and that it appears to suffer a small amount of "S-distortion" as can be seen in FIG. 6. As seen in FIG. 6 electrons in the deflection region $L_3$ travel in a cycloidic path. The resulting electron landing position on the readout device RD begins to deviate from a straight line, and "S-distortion" results particularly at large deflection electric fields. The initial conditions for electrons entering region $L_4$ can be calculated and used to find the readout device RD intercept. The illustration of FIG. 6 is for the case in which $T_4+T_5=T_c/2$. The "S-distortion" may be partially explained by the action of the non -parallel deflection plates which are sometimes used and the non-uniform fringing electric field which exists at the exit of the deflection plate region $L_3$. The experimentally determined deflection angle is $\theta_e=21°$, whereas the theoretical value is found to be $$\theta_t=\cos^{-1}[\{1-\cos 2\pi(3.13+0.21)(5.82)^{\frac{1}{2}}\}/(2^{\frac{1}{2}})]=13°.$$

Thus, the agreement between the two corresponding values of the cyclotron angle $\phi$ is $[(222°-207°)/(222°)\times 100\%]=7\%$, which is within experimental error.

Now the electron transit time spread in the magnetically focused streak tube will be considered. Electrons which leave the planar photocathode K with a component of velocity $v_o$ perpendicular to the photocathode surface experience an acceleration in a uniform electric field E normal to the photocathode K given by $$z''(t)=uE \tag{17}$$

At any given instant the electron velocity is $$z'(t)=v_0+uEt, \tag{18}$$

so that a planar electrode a distance L away is reached at time $t_0$, where $$t_0=-[v_0/(uE)]+[v_0^2/(uE)^2+2L/(uE)]^{\frac{1}{2}} \tag{19}$$

A similar expression is obtained for electrons which leave with a different initial velocity ($v_1$) perpendicular to the cathode, so that the tansmit time difference ($T_d$) is ($t_1-t_0$):

$$T_d=[(v_0-v_1)+(v_1^2+2uEL)^{\frac{1}{2}}-(V_0^2+2uEL)^{\frac{1}{2}}89/(uE). \tag{20}$$

For the special case in which the electric field is absent, $$T_d=L(v_1-v_0)/(v_1v_0).$$

Equations (20) and (21) have been used to evaluate the transit time difference in each of the five regions of the experimental tube, and the results are given in TABLE III.

TABLE III

| Region | Initial Velocity Into Region (Rest Electron) (m/s) | Initial Velocity Into Region (Energetic Electron) (m/s) | Electric Field Strength (V/m) | Region Length mm | Transit Time Spread (ps) |
|---|---|---|---|---|---|
| $L_1$ | 0 | $4.20 \times 10^5$ | $-1.00 \times 10^6$ | 2.00 | 2.41 |
| $L_2$ | $2.6533 \times 10^7$ | $2.6536 \times 10^7$ | 0 | 42.0 | 0.198 |
| $L_3$ | " | " | 0 | 20.0 | 0.094 |
| $L_4$ | " | " | 0 | 83.0 | 0.391 |
| $L_5$ | " | " | $-8.89 \times 10^5$ | 9.00 | 0.028 |
| | | | | | 3.12 (TOTAL) |

Assumptions:

V(K)=0

V(G1)=V(G2)=2.00 kV

V(T)=10.0 kV

Energetic electron leaves cathode with ½ eV energy normal to cathode

Non-relativistic motion

It is seen that region $L_1$ contributes to most of the transit time spent. It is usually the case in practical streak tubes that $v_0^2$ and $v^2$ are much smaller than 2uEL, so that equation (20) can be written as $$T_d=(v_0-v_1)/(uE). \quad (22)$$

Furthermore, if $v_1$ is taken to be zero, then $$T_d=v_0/(uE)=5.68\ v_0/E\ (ps), \text{ or} \quad (23)$$

$$T_d=(-2/u)^{\frac{1}{2}}V_0^{\frac{1}{2}}/E=3.37\times 10^{-6}V_0^{\frac{1}{2}}/E, \quad (24)$$

where $v_0$ is the electron emission energy in units of electron volts. Alternatively, for $v_1 \simeq v_0$, equation (21) becomes $$T_d=L(V_1-v_0)/v_1^2, \text{ or} \quad (25)$$

$$T_d=1.69\times 10^{-6}L\ [1-V_0/V_1)^{\frac{1}{2}}]/V_1^{\frac{1}{2}}. \quad (26)$$

One of the problems with the magnetic streak tube, described hereinabove, is that "S-distortion" and deflection defocusing exists in the output trace OT of the electron beam as it is deflected across the readout device RD. This "S-distortion" is partly caused by an increase in the electron time-of-flight from the photocathode K to the readout device RD due to the attractive force between the electrons and the deflection region $L_3$ fringing electric field, which develops near the edges of the deflection plates when deflection potentials are applied, as the electrons enter the post-deflection region $L_4$.

Figure 8:
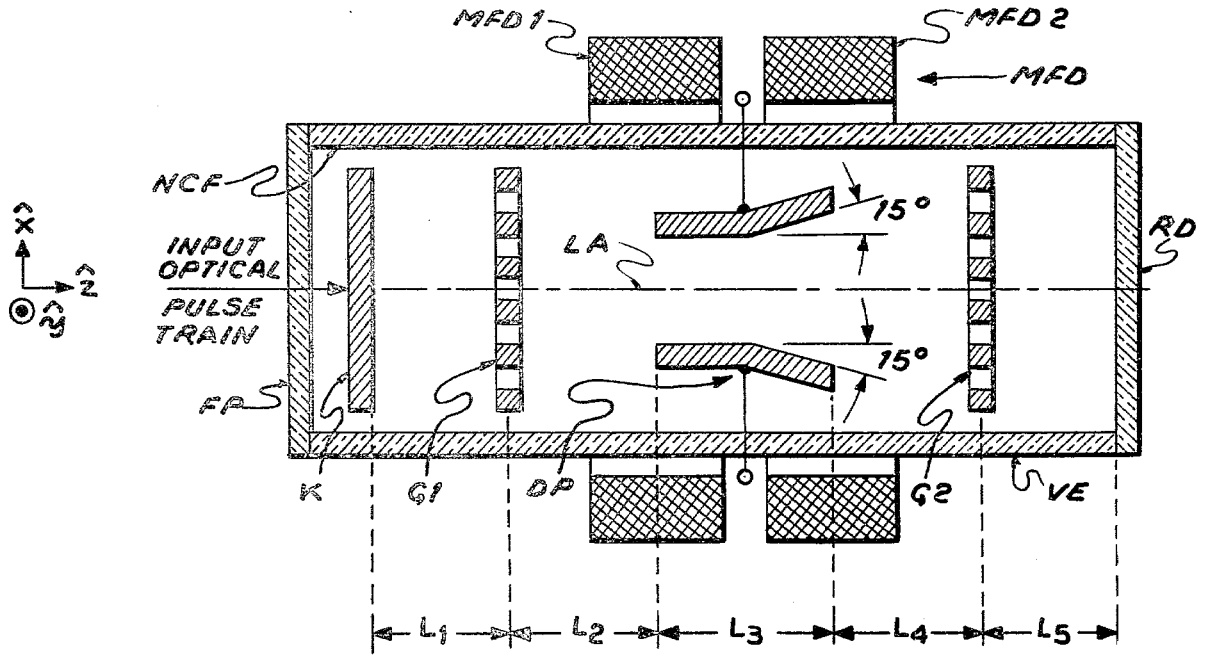
FIG. 8 is a schematic longitudinal cross-sectional view of a second embodiment of a magnetically focused streak tube in accordance with the principles of the present invention.

A technique that eliminates the "S-distortion" is to employ a non-homogeneous and steady-state magnetic focus field which has circular symmetry about the tube axis LA and which also has its maximum magnetic flux density at or near the center of the deflection region $L_3$. This type of magnetic field constrains the electrons to remain close to the axis LA of the tube so that they pass through a more uniform portion of the fringing deflection field. Furthermore, the diverging magnetic field in the post-deflection regions $L_4$ and $L_5$ increases the deflection sensitivity. This required magnetic field is produced by a short cylindrical electromagnet MFD composed of two sections MFD1 and MFD2 as shown in FIG. 8 centered with respect to and having a length slightly greater than the length of the deflection plates DP. This design also allows short and direct shielded electrical connections to be made to the deflection plates DP. Each section MFD1 and MFD2 of this electromagnet may have the same number of ampere-turns; although, separate control currents through each section allows the electron-optic magnification to be adjusted to some extent.

FIG. 8 includes all of the components of FIG. 2 which function in the same manner as FIG. 2 with the exception of that magnetic focusing device MFD described above.

Figure 9:
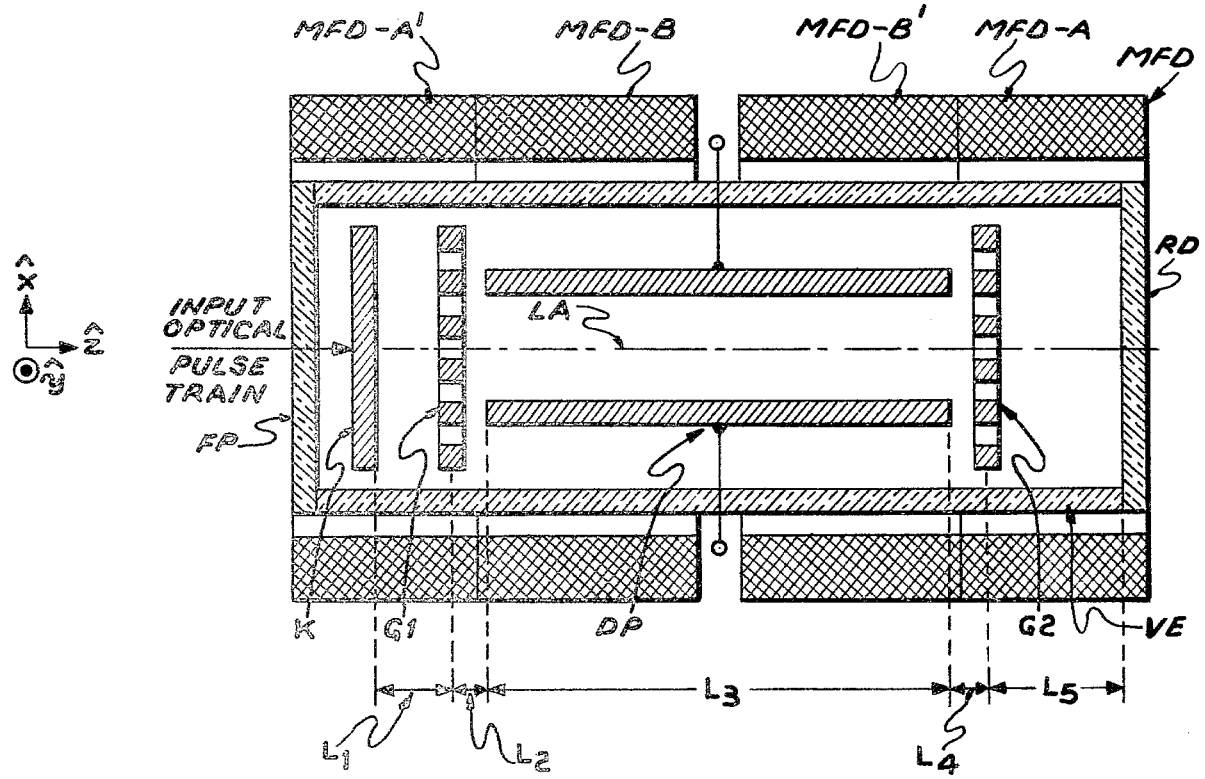
FIG. 9 is a schematic longitudinal cross-sectional view of a third embodiment of the magnetically focused streak tube in accordance with the principles of the present invention.

Another technique for the reduction of both "S-distortion" and deflection defocusing is to use long deflection plates DP as shown in FIG. 9 having a length substantially equal to the distance between electrodes G1 and G2. This deflection plate design moves the deflection region $L_3$ fringing electric field toward the focus nodes of the electron pencil, and these fringing fields thereby have a greatly reduced effect on the motion of the electrons. These long deflection plates DP also allow placing the magnetic streak tube in a uniform magnetic field. In addition, the improvements of both the short focus coil, as shown in FIG. 8 and the long deflection plates, as shown in FIG. 9 can be combined.

A four-coil focus electromagnet MFD which allows operation of the magnetic streak tube in uniform or non-uniform magnetic fields, as required by the application, is shown in FIG. 9 also. It consists of two end-coils MFD-A and MFG-A' and two center coils MFD-B and MFD-B'. The coils MFD-A and MFD-A' have more ampere-turns per unit length in the axial direction than the MFD-B and MFD-B' coils, and the purpose of the end coils MFD-A and MFD-A' is to maintain the magnetic flux density within the active portion of the tube at a constant, or nearly constant, value, when assembled as shown in FIG. 9. Note that the length of the focus electromagnet MFD is the same as the overall tube length. The MFD-B and MFD-B' coils are identical to each other, and they have a constant number of ampere-turns per unit length in the axial direction. The MFD-A and MFD-A' coils may be used alone as shown in FIG. 8 when configured as a short-electromagnet to reduce S-distortion.

Referring to FIG. 10 there is illustrated therein an embodiment of the magnetically focused streak tube in accordance with the principles of the present invention wherein the readout device is a microchannel plate MCP with electrode G2 eliminated. All of the functions of electrode G2 are carried out by the input faceplate of microchannel plate MCP. With this arrangement a readout device RD' would be required so that the proximity or magnetically focused image on the output plate of the microchannel plate MCP can be read out of the streak tube. In the alternative the readout device RD' could be eliminated and another photosensitive detector could be coupled appropriately to the microchannel plate MCP to provide the readout of the magnetically focused streak tube. The microchannel plate MCP provides the advantage of high internal electron gain, about 1,000X, while retaining good initial transfer properties. This arrangement can be employed in any of the previously described embodiments of FIGS. 2, 8 and 9.

As illustrated in FIG. 10 the magnetic focusing device MFD is the short magnetic focusing device of FIG. 8 and could be replaced by the magnetic focusing device MFD of FIG. 9.

Figure 11:
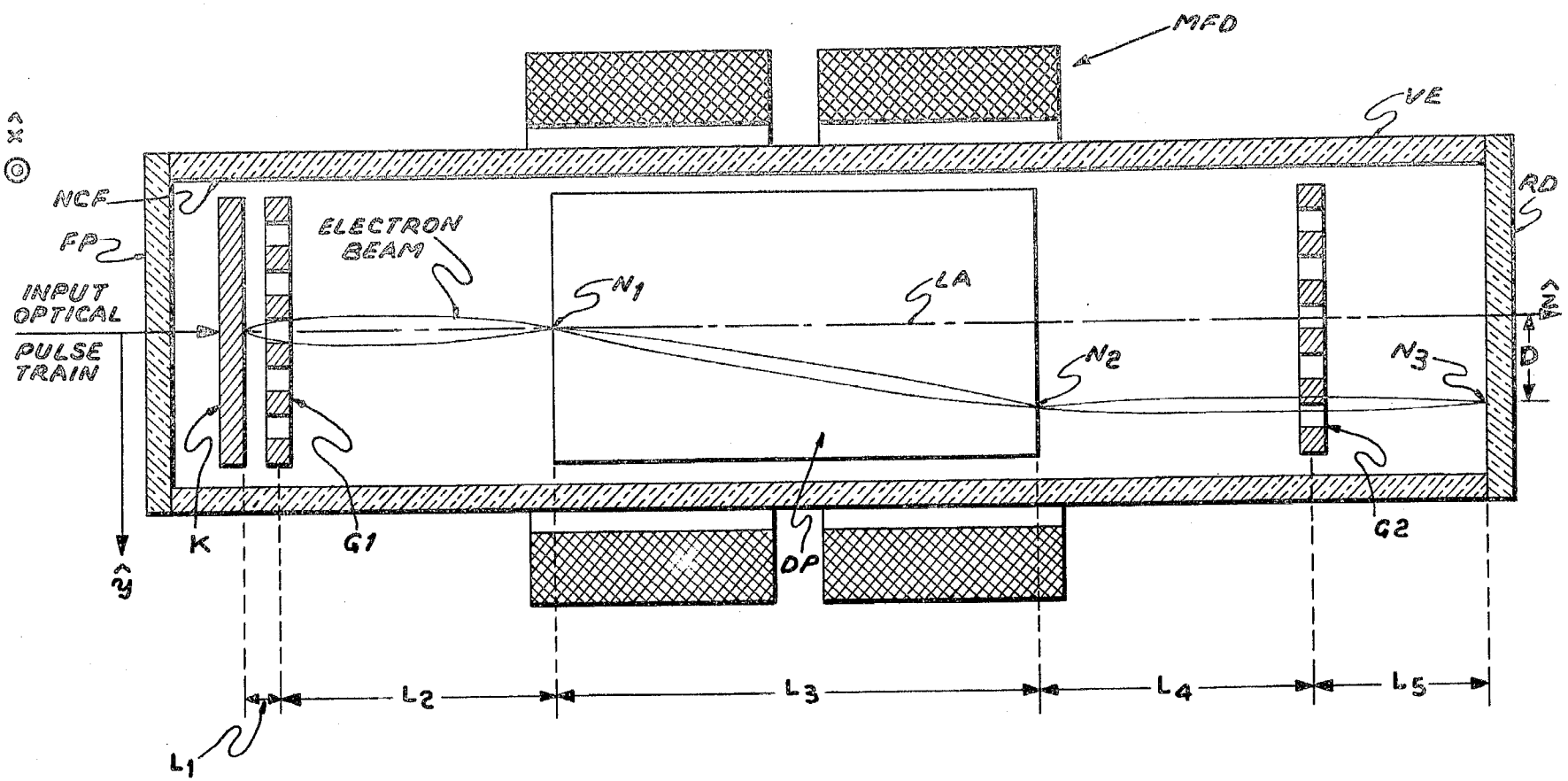
FIG. 11 is a schematic longitudinal cross-sectional diagram of a fifth embodiment of a magnetically focused streak tube in accordance with the principles of the present invention employing a 3-loop-focus technique.

Now the design characteristics of magnetically focused streak tubes in which the electrons spend an integral number of cyclotron periods inside the deflection region $L_3$ will be described. A 3-loop focus streak tube is shown in FIG. 11. It is seen that the major tube regions and electrodes are the same as shown in FIG. 2 with the exception that the magnetically focusing device MFD is of the short type as illustrated in FIG. 8, but which could be replaced by the magnetic focusing device MFD of FIG. 9. The electrode G1 is disposed extremely close to the photocathode K and accelerates the photoelectrons to high energy such as approximately 2 keV (kiloelectronvolts). The electrons then drift in region $L_2$ and reach a focus at point $N_1$ at the input to deflection plates DP. The electric field between deflection plates DP cause a "cross-field-drift" of the electrons, and the electrons reach the input to region $L_4$ at the second focus point $N_2$ (a time $2\pi/w$ after entering region $L_3$). The electrons are then allowed to drift through region $L_4$. They are finally accelerated through region $L_5$ and focused at $N_3$ on the readout device RD. The readout device RD can be any of the devices described hereinabove with respect to FIG. 2.

TABLE IV lists the baseline operating and other parameters of a 3-loop focus magnetically focused streak tube design. Note that the total transit time for photocathode K to readout device RD is 3 $T_c$ for the 10 mT magnetic field chosen.

TABLE IV

| REGION | LENGTH (mm) | FIELD COMPONENTS PRESENT | TRANSIT TIME (ns) |
|---|---|---|---|
| $L_1$ (Cathode→G1) | $L_1 = 5$ | $E_z,B_z$ | 0.38 |
| $L_2$ (G1→Deflection Plates) | $L_2 = 85$ | $B_z$ | 3.20 |
| $L_3$ (Deflection Region) | $L_3 = 95$ | $E_x,B_z$ | 3.58 |
| $L_4$ (Deflection Plates→G2) | $L_4 = 71$ | $B_z$ | 2.69 |
| $L_5$ (G2→Target) | $L_5 = 41$ | $E_z,B_z$ | 0.89 |
| | 297 | | 10.7 |

Assumptions:

| | |
|---|---|
| $B_z = 10$ mT (100G) | V(G2) = V(G1) |
| V(G1) = 2 kV | V(T) = 12 kV |
| $v_o = 5.93 \times 10^5$ m/s | (1 eV photoelectron emission energy) |
| $w = uB = 1.76 \times 10^9$ rad/s | |
| $T_c = 2\pi/w = 3.58 \times 10^{-9}$ sec | |
| $R = v_o/w = 3.37 \times 10^{-4}$ m | |

Expressions for deflection, deflection sensitivity and minimum deflection plate separation can now be derived assuming (1) homogeneous electric and magnetic fields inside the deflection region $L_3$, (2) the transit-time in the deflection region $L_3$ equals one cyclotron period, (3) the electron guiding center crossed field drift velocity $v_c$ is given by $E_d/B$, where $E_d$ is the electric field in deflection region $L_3$, (4) the electrons enter deflection region at rest in the x-y plane (finite beam diameter neglected) and (5) the streak tube electrodes are arranged as shown in FIG. 11. It follows that the electron cyclotron radius in deflection region $L_3$ is $$R=(E_d/B)/(uB)=E_d/(uB^2).$$

Figure 12:
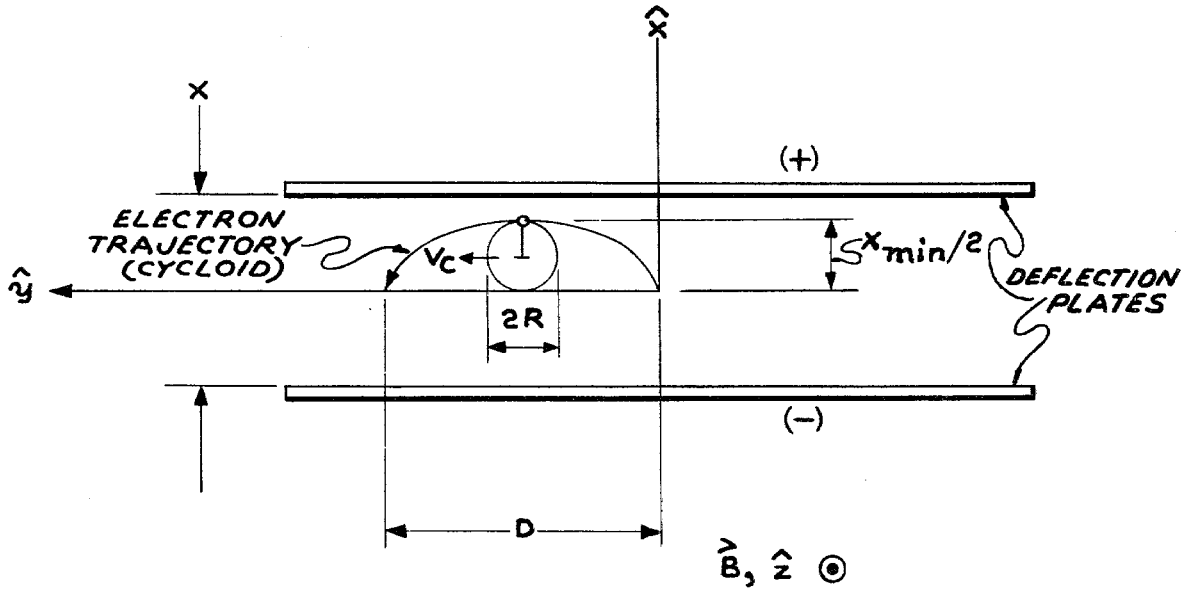
FIG. 12 is a schematic diagram illustrating the deflection parameters for the 3-loop-focus magnetic streak tube of FIG. 11.

FIG. 12 shows the deflection parameters for a 3-loop focus magnetically focused streak tube design. From FIG. 12 it is seen that the minimum deflection path separation is given by Ti $X_{min}=4R=4(V_d/X_{min})/(uB^2)$;

$$X_{min}=(2/u^{\frac{1}{2}})V_d^{\frac{1}{2}}/B,$$

$$X_{min}=4.77\times10^{-6}V_d^{\frac{1}{2}}/B.$$

The beam deflection (D) is given by $$D=v_cT_3=(E_d/B)(2\pi/w)=(2\pi/u)V_d(XB^2).$$

Thus, the maximum beam deflection ($D_{max}$) is $$D_{max}=(2\pi/u)V_{dmax}/(X_{min}B^2)=(\pi/u^{\frac{1}{2}})V_{dmax}^{\frac{1}{2}}/B.$$

Note that $$D_{max}/X_{min}=\pi/2=1.57.$$

The deflection sensitivity is $$H=D/V_d=(2\pi/u)/(X\,B^2),\text{ and}$$

$$H_{max}=(\pi/u^{\frac{1}{2}})/(B\,V_{dmax}^{\frac{1}{2}}).$$

For the baseline parameters listed in TABLE IV, it is found that $$V_{dmax}=713\text{V, and}$$

$$X_{min}=13\text{ mm.}$$

In practice, $X_{min}$ will be somewhat larger than this value to allow for the finite beam diameter and for beam-centering, etc.

This 3-loop magnetically focused streak tube design has the features that, to a first order approximation, (1) electrons enter and leave deflection region $L_3$ with the same velocity components, (2) electrons enter and leave deflection region $L_3$ at focus nodes N1 and N2 so that deflection-defocusing and deflection-distortion fringing fields do not significantly perturb the electron beam and (3) the deflection is proportional to the deflection electric field strength.

As previously mentioned, the magnetic fields required for operation of the magnetically focused streak tubes discussed hereinabove can be produced by using permanent magnets and/or electromagnets mounted outside the tube vacuum envelope VE. Uniform magnetic focusing fields have been found to yield experimental results approaching the projected performance. However, non-uniform magnetic focusing fields can be used with the magnetically focused streak tubes to produce image magnification or demagnification and/or increased deflection sensitivities.

While we have described above the principles of our invention in connection with specific apparatus it is to be clearly understood that this description is made only by way of example and not as a limitation to the scope of our invention as set forth in the objects thereof and in the accompanying claims.

We claim:

1. A magnetically focused streak tube arrangement comprising:

a vacuum envelope having a longitudinal axis and a light input faceplate disposed coaxially of said axis at one end of said envelope;

first means having a first given potential applied thereto disposed coaxial of said axis within said envelope adjacent said faceplate responsive to an optical pulse train to emit electrons into said envelope in a direct proportion to incident photon flux of said pulse train;

a first electron transparent mesh electrode having a second given potential greater than said first given potential applied thereto disposed within said envelope, coaxial of said axis and adjacent said first means to rapidly accelerate said emitted electrons away from said first means in a path parallel to said axis toward the other end of said envelope;

a second electron transparent mesh electrode having said second given potential applied thereto disposed within said envelope, coaxial of said axis and adjcent said other end of said envelope, said second given potential applied to said first and second mesh electrodes providing a region of constant potential between said first and second mesh electrodes to enable deflection of said electrons adjacent said path in said region, said electrons having a constant velocity in said region;

readout means having a third given potential greater than said second given potential applied thereto disposed in said other end of said envelope in said path adjacent said second mesh electrode, said readout means being capable of providing an output photoelectron streak image for said tube arrangement, said second given potential applied to said second mesh electrode and said third given potential cooperating to accelerate said electrons adjacent said path from said second mesh electrode to said readout means;

magnetic means disposed externally of said envelope coaxial of said axis to provide a magnetic field within said envelope substantially parallel to said path to focus said electrons on said readout means; and a pair of deflection plates each disposed within said envelope equally spaced from said path between said first and second mesh electrodes in said region to produce an electric field substantially perpendicular to said magnetic field to deflect said focused electrons across said readout means to produce said output streak image on said readout means.

2. A tube according to claim 1, wherein said first means includes a photocathode coaxial of said axis.

3. A tube according to claim 2, wherein the distance between said photocathode and said first mesh electrode, the distance between said first mesh electrode and an entrance to said deflection plates, the distance between an exit from said deflection plates and said second mesh electrode, the distance between said second mesh electrode and said readout device, the space between said deflection plates, the length of said deflection plates and the strength of said magnetic field are selected to provide a one-loop focus type of said tube.

4. A tube according to claim 2, wherein the distance between said photocathode and said first mesh electrode, the distance between said first mesh electrode and an entrance to said deflection plates, the distance between an exit from said deflection plates and said second mesh electrode, the distance between said second mesh electrode and said readout device, the space between said deflection plates, the length of said deflection plates and the strength of said magnetic field are selected to provide a multi-loop focus type of said tube.

5. A tube according to claim 2, wherein said deflection plates have a length substantially equal to the distance between said first and second mesh electrodes.

6. A tube according to claim 2, wherein said magnetic means includes a continuous magnetic focusing device having a length greater than the length of said envelope.

7. A tube according to claim 6, wherein said magnetic focusing device includes a solenoid.

8. A tube according to claim 6, wherein said magnetic focusing device includes a permanent magnet.

9. A tube according to claim 2, wherein said magnetic means includes a pair of magnetic focusing devices centered with respect to and having a length slightly greater than the length of said deflection plates.

10. A tube according to claim 9, wherein each of said magnetic focusing devices include a solenoid.

11. A tube according to claim 9, wherein each of said magnetic focusing devices include a permanent magnet.

12. A tube according to claim 2, wherein said magnetic means includes four magnetic focusing devices, one pair of said focusing devices being centered with respect to and having a length substantially coextensive with said deflection plates, one of said other pair of said focusing devices extending from one of said one pair of said focusing device to one end of said tube and the other of said other pair of focusing devices extending from the other of said one pair of said focusing device to the other end of said envelope.

13. A tube according to claim 12, wherein each of said magnetic focusing devices include a solenoid.

14. A tube according to claim 12, wherein each of said magnetic focusing devices include a permanent magnet.

15. A tube according to claim 1, wherein said deflection plates have a length substantially equal to the distance between said first and second mesh electrodes.

16. A tube according to claim 15, wherein said magnetic means includes a continuous magnetic focusing device having a length greater than the length of said envelope.

17. A tube according to claim 16, wherein said magnetic focusing device includes a solenoid.

18. A tube according to claim 16, wherein said magnetic focusing device includes a permanent magnet.

19. A tube according to claim 15, wherein said magnetic means includes a pair of magnetic focusing devices centered with respect to and having a length slightly greater than the length of said deflection plates.

20. A tube according to claim 19, wherein each of said magnetic focusing device includes a solenoid.

21. A tube according to claim 19, wherein each of said magnetic focusing device includes a permanent magnet.

22. A tube according to claim 15, wherein said magnetic means includes four magnetic focusing devices, one pair of said focusing devices being centered with respect to and having a length substantially coextensive with said deflection plates, one of said other pair of said focusing devices extending from one of said one pair of said focusing device to one end of said tube and the other of said other pair of focusing devices extending from the other of said one pair of said focusing device to the other end of said envelope.

23. A tube according to claim 22, wherein each of said magnetic focusing devices include a solenoid.

24. A tube according to claim 22, wherein each of said magnetic focusing devices include a permanent magnet.

25. A tube according to claim 1, wherein said magnetic means includes a continuous magnetic focusing device having a length greater than the length of said envelope.

26. A tube according to claim 25, wherein said magnetic focusing device includes a solenoid.

27. A tube according to claim 25, wherein said magnetic focusing device includes a permanent magnet.

28. A tube according to claim 1, wherein said magnetic means includes a pair of magnetic focusing devices centered with respect to and having a length slightly greater than the length of said deflection plates.

29. A tube according to claim 28, wherein each of said magnetic focusing device includes a solenoid.

30. A tube according to claim 28, wherein each of said magnetic focusing device includes a permanent magnet.

31. A tube according to claim 1, wherein said magnetic means includes four magnetic focusing devices, one pair of said focusing devices being centered with respect to and having a length substantially coextensive with said deflection plates, one of said other pair of said focusing devices extending from one of said one pair of said focusing device to one end of said tube and the other of said other pair of focusing devices extending from the other of said one pair of said focusing device to the other end of said envelope.

32. A tube according to claim 31, wherein each of said magnetic focusing devices include a solenoid.

33. A tube according to claim 31, wherein each of said magnetic focusing devices include a permanent magnet.

* * * * *